US009742133B1

(12) United States Patent
Chen

(10) Patent No.: US 9,742,133 B1
(45) Date of Patent: Aug. 22, 2017

(54) POWER CONNECTOR HAVING A HOUSING WITH A T-SHAPED TONGUE AND EACH TERMINAL WITH PARALLEL AND SEPARATED CONTACT PORTIONS

(71) Applicant: OUPIIN ELECTRONIC (KUNSHAN) CO., LTD., Jiangsu Province (CN)

(72) Inventor: Hsin Chih Chen, Jiangsu Province (CN)

(73) Assignee: OUPIIN ELECTRONIC (KUNSHAN) CO., LTD., Jiangsu Province (CN)

( * ) Notice: Subject to any disclaimer, the term of this patent is extended or adjusted under 35 U.S.C. 154(b) by 0 days.

(21) Appl. No.: 15/369,306

(22) Filed: Dec. 5, 2016

(30) Foreign Application Priority Data

Apr. 22, 2016 (CN) ..... 2016 1 0253470

(51) Int. Cl.
*H01R 24/00* (2011.01)
*H01R 24/60* (2011.01)
*H01R 107/00* (2006.01)

(52) U.S. Cl.
CPC ..... *H01R 24/60* (2013.01); *H01R 2107/00* (2013.01)

(58) Field of Classification Search
CPC .. H01R 12/724; H01R 12/7088; H01R 24/00; H01R 24/60; H01R 24/62; H01R 24/86
USPC ..... 439/676, 541.5, 78, 79
See application file for complete search history.

(56) References Cited

U.S. PATENT DOCUMENTS 6,394,818 B1 * 5/2002 Smalley, Jr. ..... H01R 12/7088 439/181
7,488,217 B2 * 2/2009 Cheng ..... H01R 13/11 439/668
7,717,745 B2 * 5/2010 He ..... H01R 13/642 439/607.23
7,726,982 B2 * 6/2010 Ngo ..... H01R 13/42 439/206
7,775,829 B2 * 8/2010 Zhang ..... H01R 13/6658 439/541.5
8,057,266 B1 * 11/2011 Roitberg ..... H01R 12/724 439/682
8,366,458 B2 * 2/2013 Ngo ..... H01R 12/724 439/79

* cited by examiner

*Primary Examiner* — Chandrika Prasad
(74) *Attorney, Agent, or Firm* — WPAT, P.C., Intellectual Property Attorneys; Anthony King

(57) ABSTRACT

A power connector is disclosed in this invention, including an insulating housing and at least one pair of power terminals. The insulating housing includes a T-type tongue plate, which has a flange, multiple grooves formed on two opposite surfaces of the tongue plate, and multiple ribs separating the grooves. Each power terminal includes a retaining plate, multiple parallel and separated contact portions mounted into the corresponding grooves and multiple parallel and separated mounting portions. The power terminal of the present invention can realize the power distribution and improve the heat dissipation performance of the power terminal by disposing these contact portions and defining heat-dissipating channels between these contact portions.

7 Claims, 7 Drawing Sheets

POWER CONNECTOR HAVING A HOUSING WITH A T-SHAPED TONGUE AND EACH TERMINAL WITH PARALLEL AND SEPARATED CONTACT PORTIONS

BACKGROUND OF THE INVENTION

1. Field of the Invention

The present invention relates to a connector technology, and more particularly to a power connector and a power terminal with multiple horizontal contact portions.

2. Description of the Prior Art

With the increase of the current, a power connector will face such problems as the size limitation of power terminals and the unexpected accumulation of heat. At present, the power connector needs to possess a higher heat dissipation performance and a lower power loss. In order to meet these demands, the manufacturer must ensure that the power connector has a smaller profile and a more compact structure, while providing products with a high linear current density.

Hence, it is needed to provide a power terminal with multiple horizontal contact portions and a power connector employing the same for satisfying the market's demand.

BRIEF SUMMARY OF THE INVENTION

One object of the present invention is to provide a power connector, which employs a power terminal with multiple horizontal contact portions and defines heat-dissipating channels between these horizontal contact portions, to realize the power distribution and improve the heat dissipation performance of the power terminal, and to make a power connector be more compact and stable by the combination of the power terminal and an insulating housing.

The other object of the present invention is to provide a power terminal, which has multiple horizontal contact portions and defines heat-dissipating channels therebetween, to realize the power distribution and improve the heat dissipation performance of the power terminal.

Other objects and advantages of the present invention may be further understood from the technical features disclosed by the present invention.

To achieve the aforementioned object or other objects of the present invention, the present invention adopts the following technical solution.

The present invention provides a power connector, which comprises an insulating housing and at least one pair of power terminals. The insulating housing includes at least one insertion port on the front thereof, a cavity extending backward from the insertion port, a tongue plate extending into the cavity, a first terminal-receiving passage being located on one side of the tongue plate and passing through the cavity and the rear of the insulating housing, and a second terminal-receiving passage being located on the other side of the tongue plate and passing through the cavity and the rear of the insulating housing. Wherein the tongue plate is T type and has a flange on the front thereof, multiple grooves formed on two opposite surfaces of the tongue plate, and multiple ribs formed on the two opposite surfaces of the tongue plate to separate the grooves. The grooves on one surface of the tongue plate are communicated with the first terminal-receiving passage, and the grooves on the other surface of the tongue plate are communicated with the second terminal-receiving passage. The pair of power terminals includes two similar power terminals, each of which includes a retaining plate, multiple parallel and separated contact portions located on one end of the retaining plate, and multiple parallel and separated mounting portions located on the other end of the retaining plate. The contact portions of one power terminal enter into the corresponding grooves of the tongue plate along the first terminal-receiving passage, the contact portions of the other power terminal enter into the corresponding grooves of the tongue plate along the second terminal-receiving passage, and the mounting portions of the two power terminals extend out of the bottom of the insulating housing.

In one embodiment, the insertion port is a horizontal port, the tongue plate is a horizontal plate, the first terminal-receiving passage is located above the tongue plate, and the second terminal-receiving passage is located under the tongue plate.

In one embodiment, the two opposite surfaces are the top and bottom of the tongue plate.

In one embodiment, the grooves on the top of the tongue plate are communicated with the first terminal-receiving passage, and the grooves on the bottom of the tongue plate are communicated with the second terminal-receiving passage; the ribs extend from the front of the tongue plate to a rear wall of the cavity.

In one embodiment, the retaining plate is an L-shaped plate, which has a horizontal section and a vertical section; and the horizontal section forms a barb structure on two sides thereof.

In one embodiment, the contact portions of each power terminal horizontally extend forward from the front of the horizontal section in parallel, and the mounting portions of each power terminal vertically extend downward from the bottom of the vertical section in parallel.

In one embodiment, the two power terminals are arranged up and down, and the size of the retaining plate of one power terminal is larger than that of the retaining plate of the other power terminal.

The present invention further provides a power terminal, which includes a retaining plate, multiple parallel and separated contact portions located on one end of the retaining plate, and multiple parallel and separated mounting portions located on the other end of the retaining plate.

In one embodiment, the retaining plate is an L-shaped plate, which has a horizontal section and a vertical section; the contact portions horizontally extend forward from the front of the horizontal section in parallel, and the mounting portions vertically extend downward from the bottom of the vertical section in parallel; the contact portions are located on a same horizontal plane, and the mounting portions are located on a same vertical plane.

In one embodiment, the horizontal section forms a barb structure on two sides thereof.

In comparison with the prior art, the power terminal of the present invention disposes multiple horizontal contact portions and defines heat-dissipating channels between these horizontal contact portions, to realize the power distribution and improve the heat dissipation performance of the power terminal. Moreover, the power connector of the present invention disposes a T-type tongue plate to make the power terminal and the insulating housing be a perfect combination and further make the power connector be more compact and stable.

DETAILED DESCRIPTION OF THE PREFERRED EMBODIMENTS

The following description of every embodiment with reference to the accompanying drawings is used to exemplify a specific embodiment, which may be carried out in the present invention. Directional terms mentioned in the present invention, such as "up", "down", "front", "back", "left", "right", "top", "bottom" etc., are only used with reference to the orientation of the accompanying drawings. Therefore, the used directional terms are intended to illustrate, but not to limit, the present invention.

Please refer to FIGS. 1 to 4, a power connector 1 of the present invention is a right angle type plug connector, the mating direction of which is parallel to a circuit board (not shown), on which the power connector 1 is mounted. The power connector 1 includes an insulating housing 10 and at least one pair of power terminals 20, 20'. In the embodiment, the power connector 1 includes four pairs of power terminals 20, 20', which are horizontally arranged. But in fact, the protection scope of the present invention can not be limited by the number of the power terminals 20, 20'.

Figure 1:
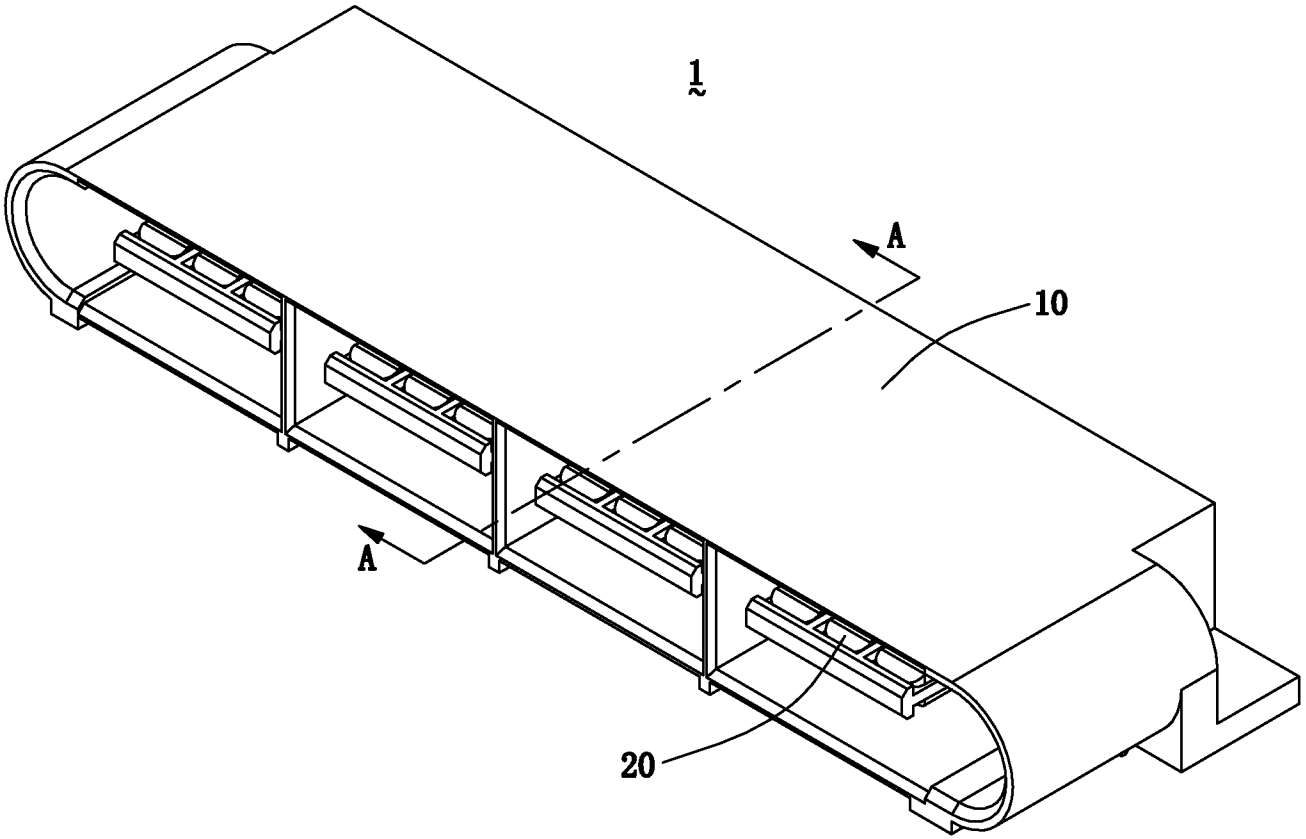
FIG. 1 is a perspective schematic view of a power connector of the present invention.
Figure 2:
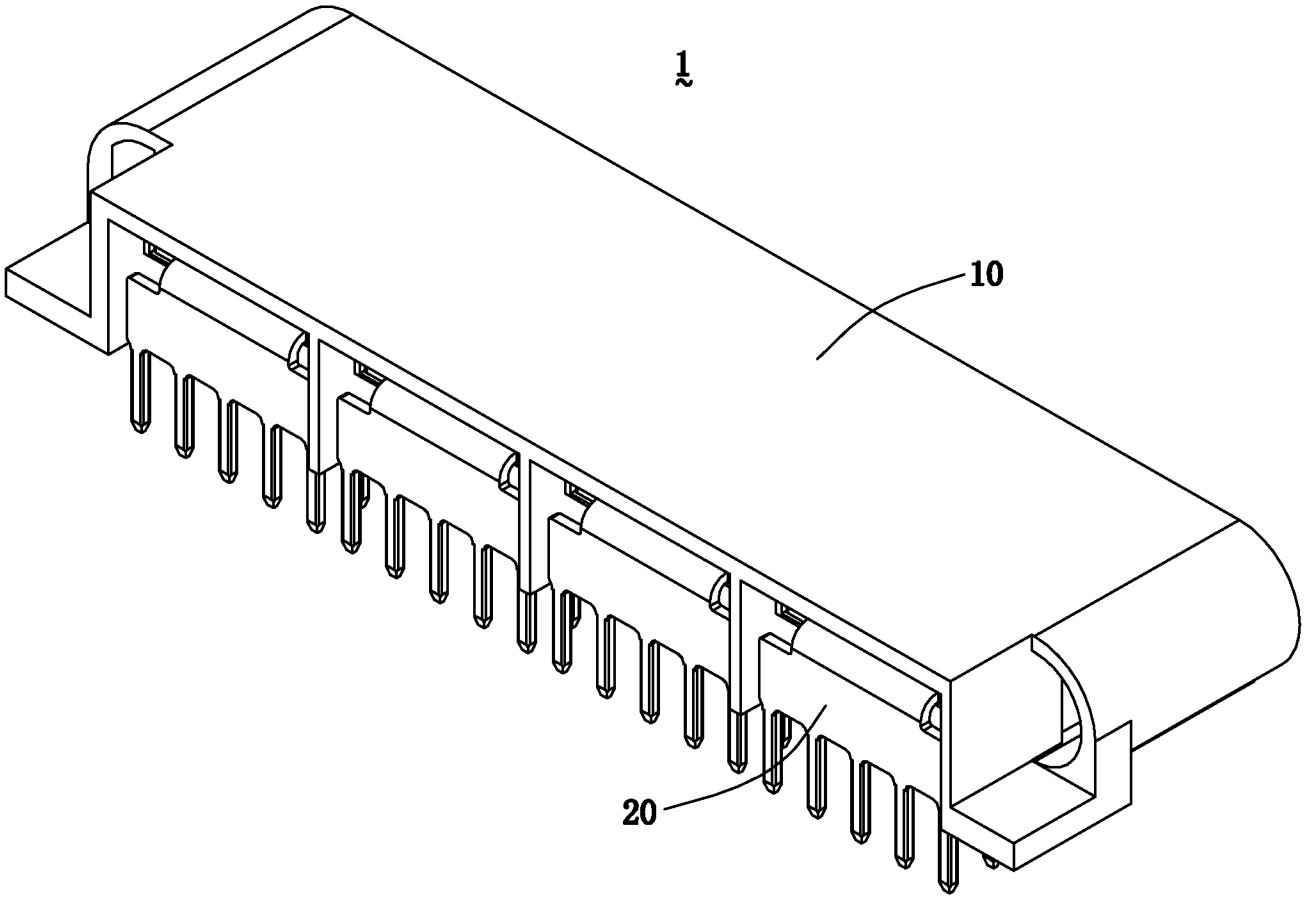
FIG. 2 is a perspective schematic view of the power connector along another direction.
Figure 3:
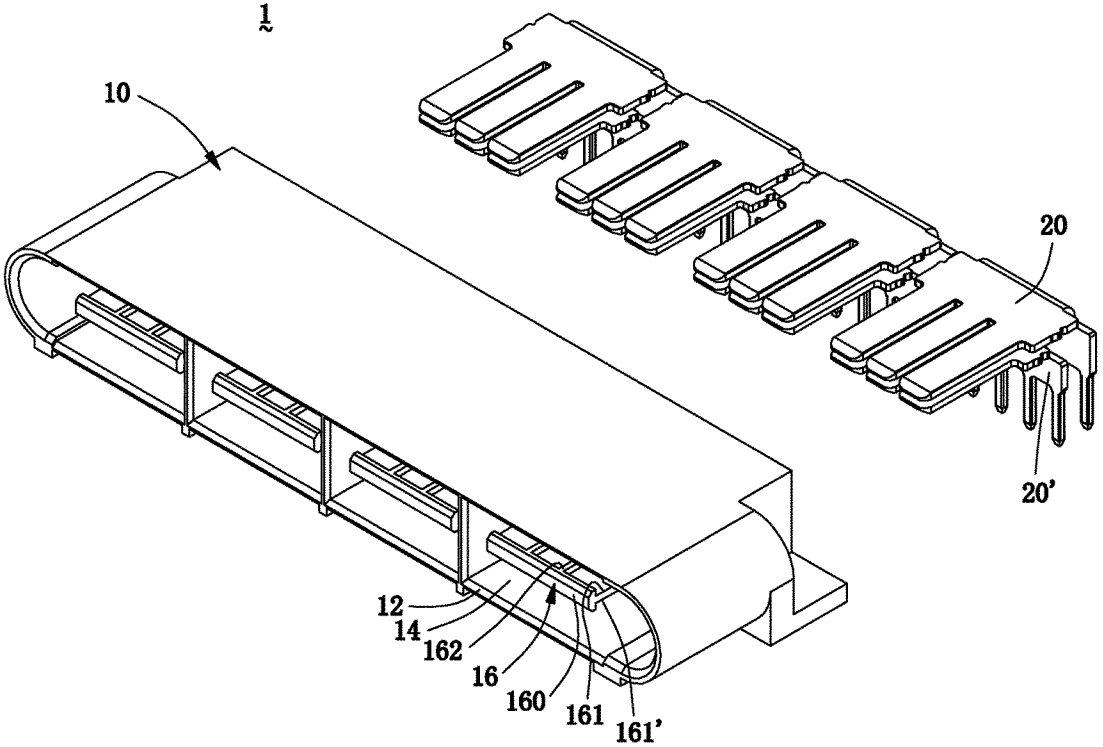
FIG. 3 is an exploded view of the power connector of the present invention.
Figure 4:
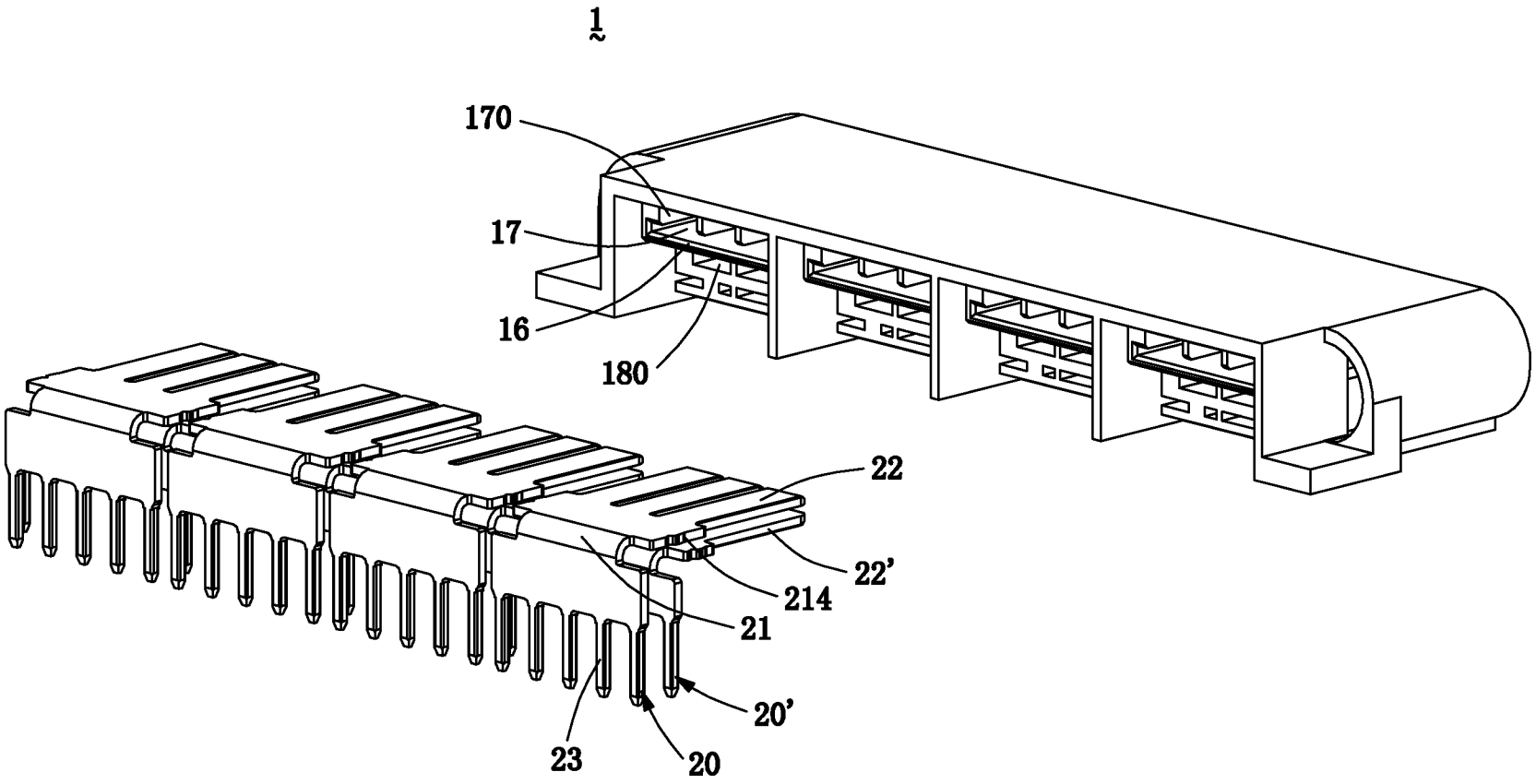
FIG. 4 is an exploded view of the power connector along another direction.
Figure 6:
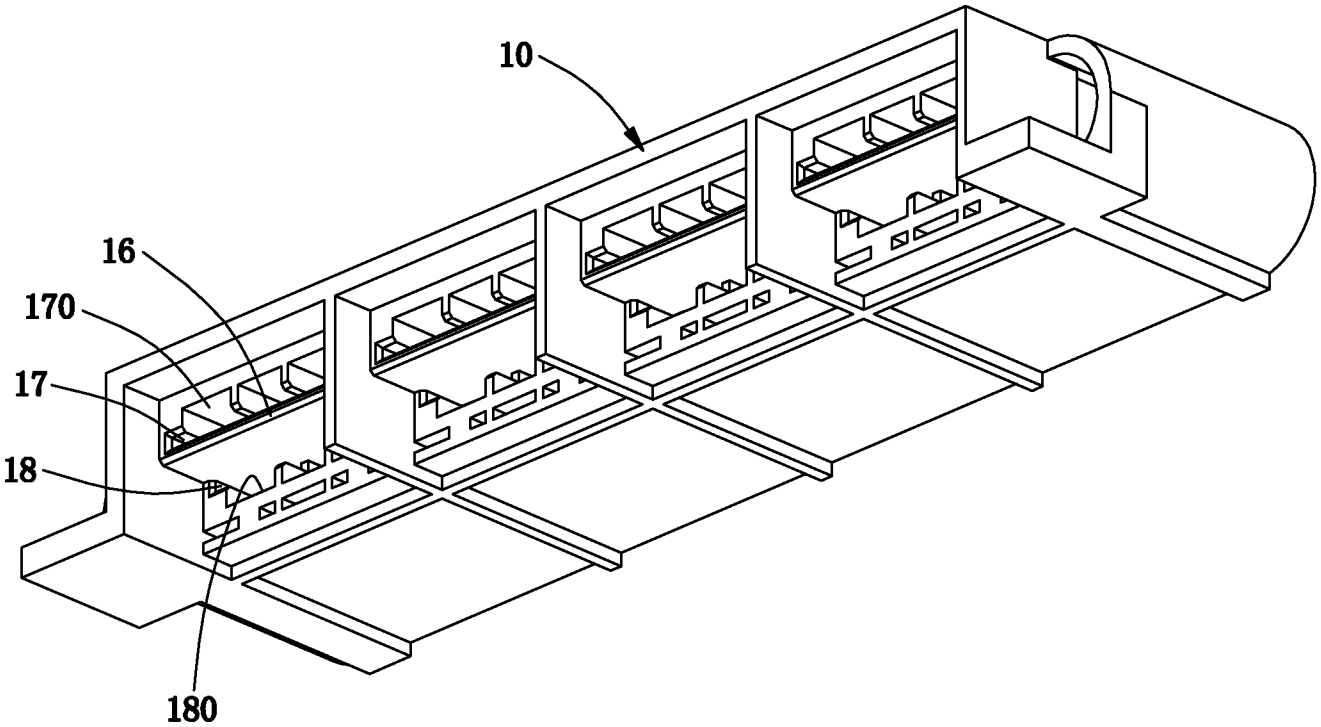
FIG. 6 is a perspective schematic view of an insulating housing of the present invention.

Please refer to FIGS. 3, 4 and 6, the insulating housing 10 includes at least one insertion port 12 being located on the front of the insulating housing 10, a cavity 14 extending backward from the insertion port 12, a tongue plate 16 extending into the cavity 14, a first terminal-receiving passage 17 being located on one side of the tongue plate 16 and passing through the cavity 14 and the rear of the insulating housing 10, and a second terminal-receiving passage 18 (label seen in FIG. 6) being located on the other side of the tongue plate 16 and passing through the cavity 14 and the rear of the insulating housing 10.

Moreover, as shown in FIGS. 4 and 6, the insulating housing 10 further includes multiple first openings 170 being located above and facing the first terminal-receiving passage 17, and multiple second openings 180 being located under and facing the second terminal-receiving passage 18. The first and second openings 170, 180 are mainly used to provide the heat dissipation function.

In the embodiment, the insertion port 12 is a horizontal port 12, the tongue plate 16 is a horizontal plate 16, the first terminal-receiving passage 17 is located above the tongue plate 16, and the second terminal-receiving passage 18 is located under the tongue plate 16. Of course, in other embodiments, the insertion port 12 and the tongue plate 16 can be vertical according to the factual demand.

In the embodiment, the insulating housing 10 includes four insertion ports 12, which are horizontally arranged to be one row. Similarly, the number of the insertion ports 12 can not be used to limit the protect scope of this invention.

Figure 7:
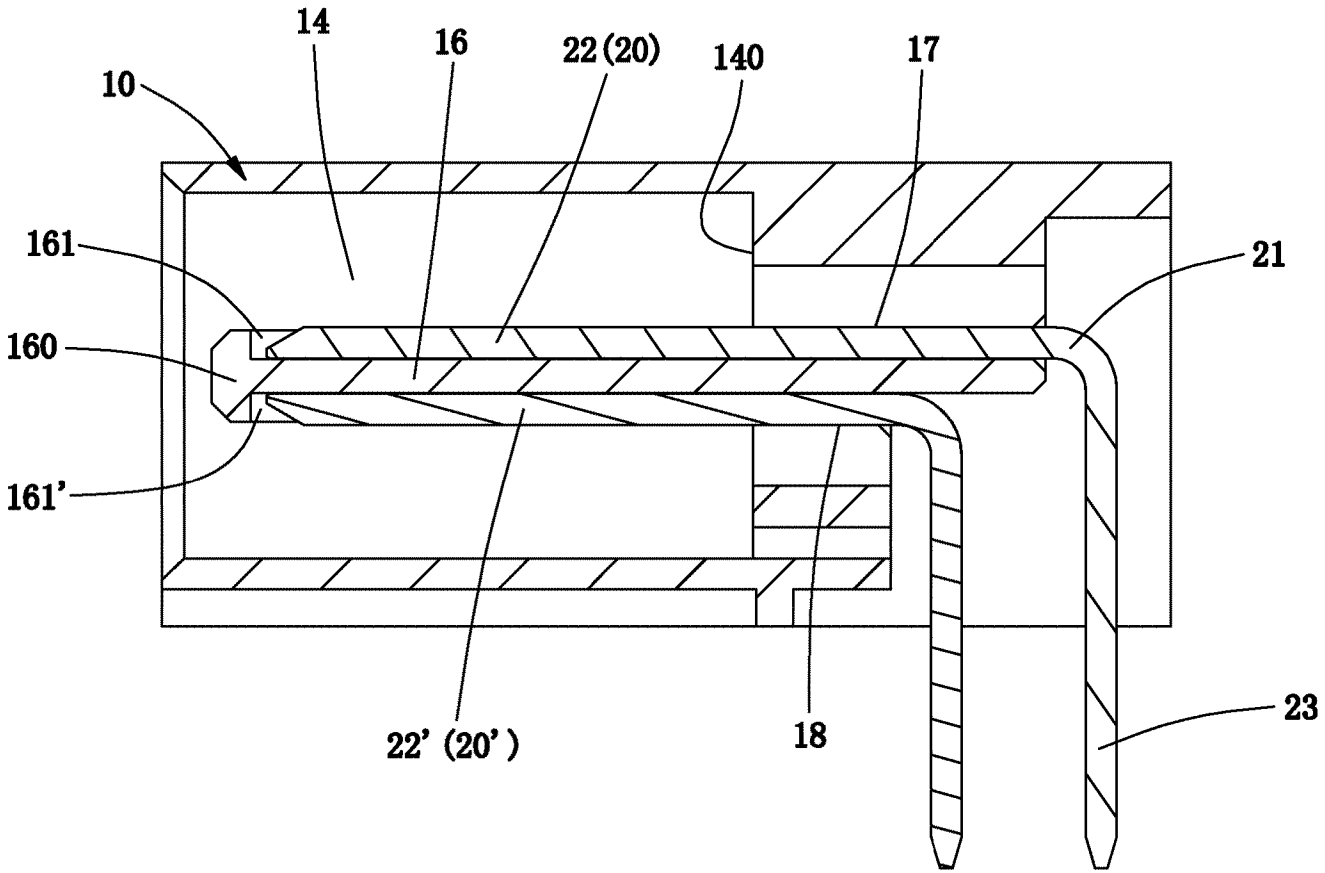
FIG. 7 is a sectional view along line A-A in FIG. 1.

As shown in FIGS. 3 and 7, the cross section of the tongue plate 16 is T type. Specifically, the tongue plate 16 has a flange 160 on the front thereof, multiple grooves 161, 161' formed on two opposite surfaces of the tongue plate 16, and multiple ribs 162 formed on two opposite surfaces of the tongue plate 16 to separate the grooves 161, 161'. The grooves 161 on one surface of the tongue plate 16 are communicated with the first terminal-receiving passage 17, and the grooves 161' on the other surface of the tongue plate 16 are communicated with the second terminal-receiving passage 18.

In the embodiment, the two opposite surfaces are the top and bottom of the tongue plate 16. Due to the view angle of drawing, FIG. 3 can clearly show the grooves 161 and the ribs 162 on the top of the tongue plate 16, but can show only one groove 161' on the bottom of the tongue plate 16, and can not show any ribs on the bottom of the tongue plate 16. Furthermore, as shown in FIG. 7, the grooves 161 on the top of the tongue plate 16 are communicated with the first terminal-receiving passage 17, and the grooves 161' on the bottom of the tongue plate 16 are communicated with the second terminal-receiving passage 18, and the ribs 162 generally extend from the front of the tongue plate 16 to a rear wall 140 (label only seen in FIG. 7) of the cavity 14.

The following text will take one pair of power terminals 20, 20' as an example to introduce the structure of the power terminal of the present invention and further introduce the assembly relation between the power terminal and the insulating housing 10.

Figure 5:
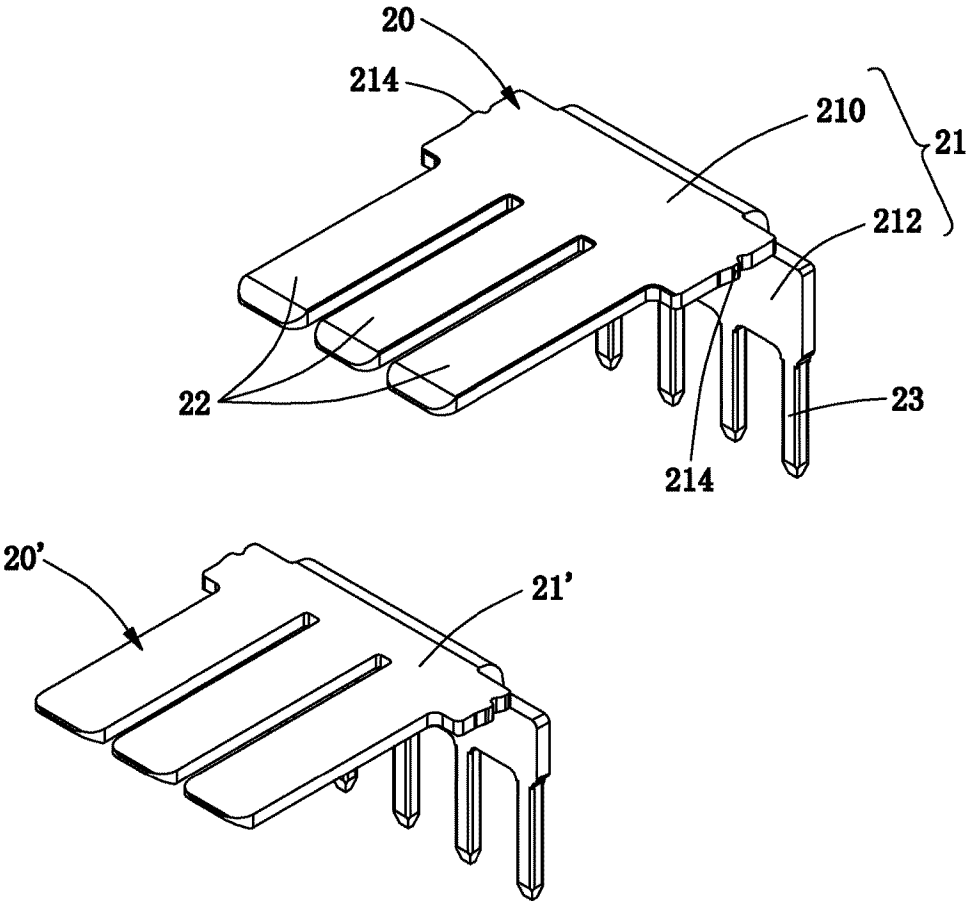
FIG. 5 is a perspective schematic view of one pair of power terminals of the present invention.

As show in FIG. 5, this pair of power terminals 20, 20' includes two similar power terminals 20, 20'. Here, the detailed structure of only one power terminal 20 is introduced in detail. The power terminal 20 includes a retaining plate 21, multiple parallel contact portions 22 located on one end of the retaining plate 21 and separated from each other, and multiple parallel mounting portions 23 located on the other end of the retaining plate 21 and separated from each other.

As shown in FIG. 5, in the embodiment, the retaining plate 21 is an L-shaped plate, which has a horizontal section 210 and a vertical section 212. The horizontal section 210 forms a barb structure 214 on two sides thereof. The contact portions 22 horizontally extend forward from the front of the horizontal section 210 in parallel, and the mounting portions 23 vertically extend downward from the bottom of the vertical section 212 in parallel. That is to say, the contact portions 22 are located on a same horizontal plane, and the mounting portions 23 are located on a same vertical plane. Therefore, the power terminal 20 of the present invention can realize the power distribution by employing the multiple separated contact portions 22, and can improve the heat dissipation performance by defining multiple heat-dissipating channels between these contact portions 22.

As shown in FIG. 5, the difference between the two power terminals 20, 20' is that the sizes of the retaining plates 21, 21' thereof are different. In the embodiment, the two power terminals 20, 20' are arranged up and down. The size of the retaining plate 21 of one power terminal 20 is larger than that of the retaining plate 21' of the other power terminal 20'.

Of course, in other embodiments, the retaining plate 21 can be flat-type according to the actual demand. When the retaining plate 21 is flat-type, the contact portions 22 can horizontally extend forward from the front of the retaining plate 21 in parallel, and the mounting portions 23 can horizontally extend backward from the rear of the retaining plate 21 in parallel.

As shown in FIGS. 4 and 7, the contact portions 22 of one power terminal 20 enter into the corresponding grooves 161 of the tongue plate 16 along the first terminal-receiving passage 17, and the contact portions 22' of the other power terminal 20' enter into the corresponding grooves 161 along the second terminal-receiving passage 18 (label seen in FIG. 6). The contact portions 22, 22' are exposed in the cavity 14 of the insulating housing 10 to be ready to be engaged with an outer receptacle connector. Further, the retaining plate 21 of the power terminal 20 is retained in the first terminal-receiving passage 17 by the barb structure 214, and the mounting portions 23 thereof extend out of the bottom of the insulating housing for being ready to be connected with the circuit board.

As described above, the power terminal 20 of the present invention disposes multiple horizontal contact portions 22 and defines heat-dissipating channels between these horizontal contact portions 22, to realize the power distribution and improve the heat dissipation performance of the power terminal 20. Moreover, the power connector 1 of the present invention disposes a T-type tongue plate 16 to make the power terminal 20 and the insulating housing 10 be a perfect combination and further make the power connector 1 be more compact and stable.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A power connector, which comprises:

an insulating housing including at least one insertion port on the front thereof, a cavity extending backward from the insertion port, a tongue plate extending into the cavity, a first terminal-receiving passage being located on one side of the tongue plate and passing through the cavity and the rear of the insulating housing, and a second terminal-receiving passage being located on the other side of the tongue plate and passing through the cavity and the rear of the insulating housing; wherein the tongue plate is T type and has a flange on the front thereof, multiple grooves formed on two opposite surfaces of the tongue plate, and multiple ribs formed on the two opposite surfaces of the tongue plate to separate the grooves; the grooves on one surface of the tongue plate being communicated with the first terminal-receiving passage, and the grooves on the other surface of the tongue plate being communicated with the second terminal-receiving passage; and at least one pair of power terminals including two similar power terminals, each of which includes a retaining plate, multiple parallel and separated contact portions located on one end of the retaining plate, and multiple parallel and separated mounting portions located on the other end of the retaining plate; the contact portions of one power terminal entering into the corresponding grooves of the tongue plate along the first terminal-receiving passage, the contact portions of the other power terminal entering into the corresponding grooves of the tongue plate along the second terminal-receiving passage, and the mounting portions of the two power terminals extending out of the bottom of the insulating housing.

2. The power connector as claimed in claim 1, wherein the insertion port is a horizontal port, the tongue plate is a horizontal plate, the first terminal-receiving passage is located above the tongue plate, and the second terminal-receiving passage is located under the tongue plate.

3. The power connector as claimed in claim 2, wherein the two opposite surfaces are the top and bottom of the tongue plate.

4. The power connector as claimed in claim 3, wherein the grooves on the top of the tongue plate are communicated with the first terminal-receiving passage, and the grooves on the bottom of the tongue plate are communicated with the second terminal-receiving passage; the ribs extend from the front of the tongue plate to a rear wall of the cavity.

5. The power connector as claimed in claim 1, wherein the retaining plate is an L-shaped plate, which has a horizontal section and a vertical section; and the horizontal section forms a barb structure on two sides thereof.

6. The power connector as claimed in claim 5, wherein the contact portions of each power terminal horizontally extend forward from the front of the horizontal section in parallel, and the mounting portions of each power terminal vertically extend downward from the bottom of the vertical section in parallel.

7. The power connector as claimed in claim 6, wherein the two power terminals are arranged up and down, and the size of the retaining plate of one power terminal is larger than that of the retaining plate of the other power terminal.

* * * * *